US007131938B2

(12) United States Patent
Cao

(10) Patent No.: US 7,131,938 B2
(45) Date of Patent: Nov. 7, 2006

(54) APPARATUS FOR WEIGHT HEADS ASSEMBLY USED ON DUMBBELLS

(76) Inventor: Guofang Cao, 22801 Chardonnay Dr., #1, Diamond Bar, CA (US) 91765

( * ) Notice: Subject to any disclaimer, the term of this patent is extended or adjusted under 35 U.S.C. 154(b) by 0 days.

(21) Appl. No.: 10/906,026

(22) Filed: Jan. 31, 2005

(65) Prior Publication Data

US 2006/0172871 A1 Aug. 3, 2006

(51) Int. Cl.
*A63B 21/72* (2006.01)
*A63B 21/75* (2006.01)
*A63B 23/16* (2006.01)

(52) U.S. Cl. ..... 482/106; 482/50; 482/107; 482/108

(58) Field of Classification Search ..... 482/106, 482/107–108
See application file for complete search history.

(56) References Cited

U.S. PATENT DOCUMENTS 4,638,994 A * 1/1987 Gogarty ..... 482/107
5,171,199 A * 12/1992 Panagos ..... 482/106
5,222,930 A * 6/1993 Bold, Jr. ..... 482/132
5,484,367 A * 1/1996 Martinez ..... 482/107
6,059,700 A * 5/2000 Ellenburg ..... 482/107
6,592,499 B1 * 7/2003 Parker ..... 482/106
6,599,222 B1 * 7/2003 Wince ..... 482/106
D486,536 S * 2/2004 Patti ..... D21/681
6,770,016 B1 * 8/2004 Anderson et al. ..... 482/106
6,875,161 B1 * 4/2005 Brice ..... 482/107
2003/0232705 A1 * 12/2003 Harms et al. ..... 482/108

* cited by examiner

*Primary Examiner*—Stephen R. Crow
*Assistant Examiner*—Arun Chhabra
(74) *Attorney, Agent, or Firm*—Jen-Feng Lee, Esq.

(57) ABSTRACT

Weight head assembly for dumbbells that eliminates a weak point on the handle bar, so as to increase the durability of a handle bar on dumbbells. Under present invention, the 'stub' portion, where the handlebar is inserted into the weight heads on the two ends of the bar, need not be machined down in size at the junction point between handle bar and weight head, and can thus withstand more wear and tear for regular usage in fitness training. The cost of manufacturing the handle bar, and as a result of the increase durability, will help the fitness industry greatly when making new dumbbells.

1 Claim, 7 Drawing Sheets

APPARATUS FOR WEIGHT HEADS ASSEMBLY USED ON DUMBBELLS

FIELD AND BACKGROUND OF THE INVENTION

The present invention relates generally to design and construction of dumbbell weight heads assembly used on fitness training equipment. Specifically, the problem of a weak point on the handle bar, as located at the junction point between handle bar and the weight heads, will be eliminated by the construction pursuant to present invention.

Traditional dumbbells have a handle bar with two ends attaching to the bells, called weight heads.

To prevent the two dumbbells from sliding towards the center of the handle bar, two collars are commonly used for this purpose. The load-bearing portion (called 'stub') on the two ends of the handle bar is usually machined down to reduce the diameter so that the collars would properly be 'pinched' in place and serve to prevent the dumbbells from sliding towards the center of the handle bar. See FIG. 1, showing prior art industry usage.

The problems with the common industry usage include, at least, first, tremendous pressure exerted to the junction point between the stub portion (which has reduced diameter, thus reduced strength) and the central handle bar, and second, the high cost for the need to machine down the diameter of the stub to provide the hold pattern for the collars as well as the load-bearing portion that takes the weight head.

OBJECTS AND SUMMARY OF THE INVENTION

Present invention provides an improved dumbbell assembly without causing a weakened portion of the handle bar, thus making the dumbbell more durable, and an inexpensive mechanism for securing the dumbbells in place.

DESCRIPTION OF THE DRAWINGS

The accompanying drawings, which are incorporated in and constitute a part of this specification, illustrate the preferred embodiments of the invention and together with the description, serve to explain the principles of the invention.

A brief description of the drawings is as follows.

DETAILED DESCRIPTION OF THE PREFERRED EMBODIMENT

Figure 1:
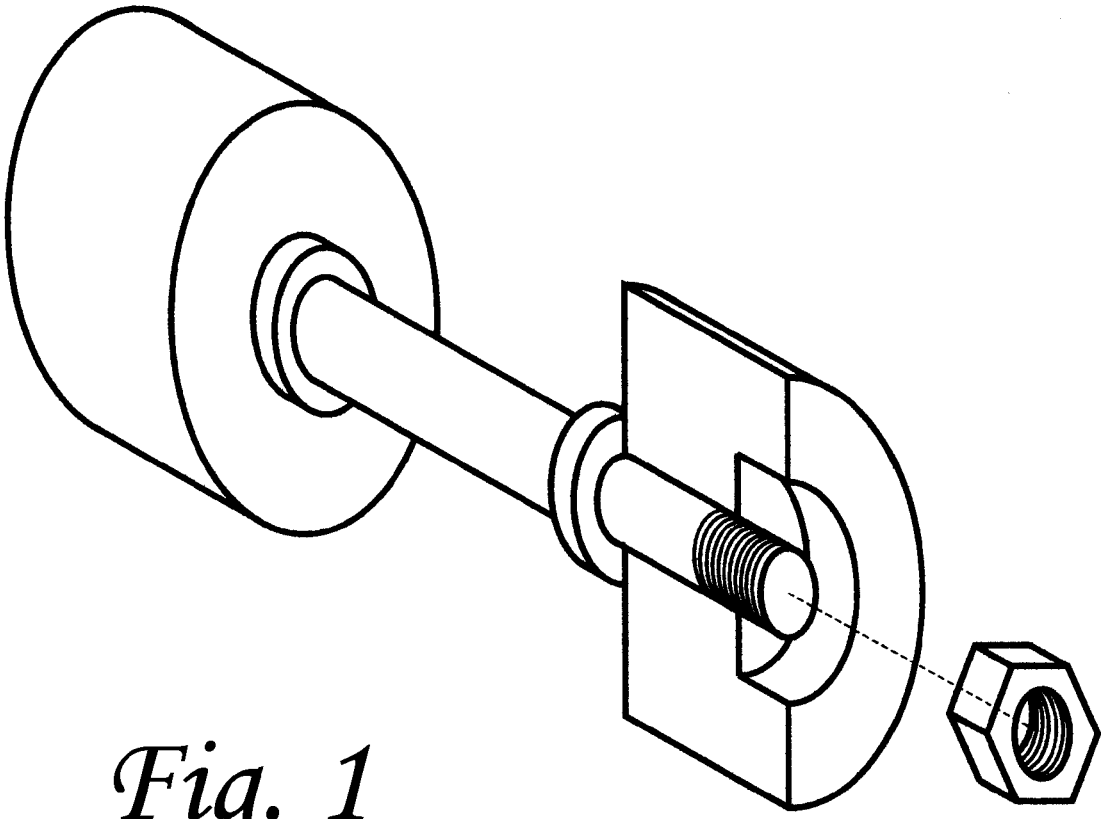
FIG. 1 shows common dumbbell assembly, having reduced (weakened) stub.

In FIG. 1, a common dumbbell is shown. Two collars are used to stop the weight heads from sliding towards the middle of the handle bar. The collars have an opening sized to fit the stub portion of the handle bar. The stub portion is machined from an integral handle bar and becomes smaller in diameter, and serves as the load-bearing part inserted into the weight heads.

A lock nut is used to secure the weight head.

FIGS. 2–5 show the first embodiment of present invention.

Figure 2:
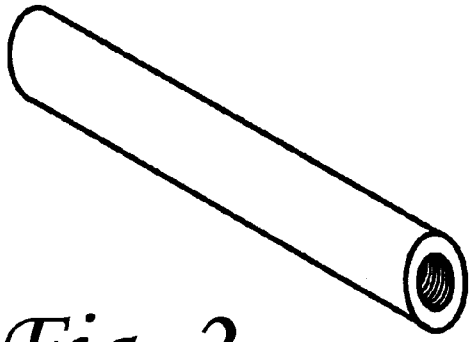
FIG. 2 shows a first embodiment of the central handle bar of present invention.

FIG. 2 shows a central handle bar having 2 non-through holes drilled in axially from the end. Thread lines are machined to the inside wall of said non-through holes. The handle bar's outside diameter remains the same throughout.

Figure 3:
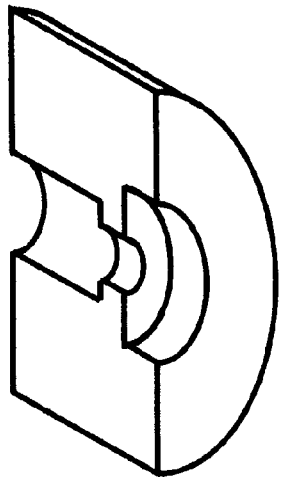
FIG. 3 shows a first embodiment of weight heads of present invention.
Figure 4:
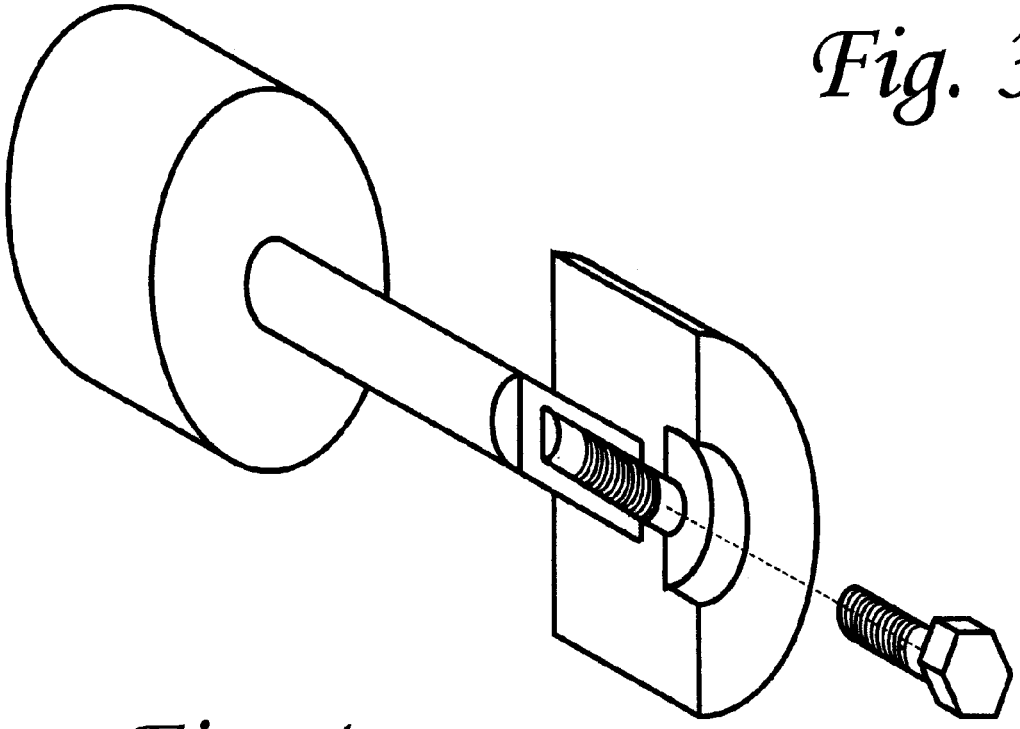
FIG. 4 shows an exploded view for the first embodiment of present invention.

FIGS. 3 and 4 show the cut-out view of the weight head, which has a through hole divided into 3 sections, having 3 respective diameters.

Figure 5:
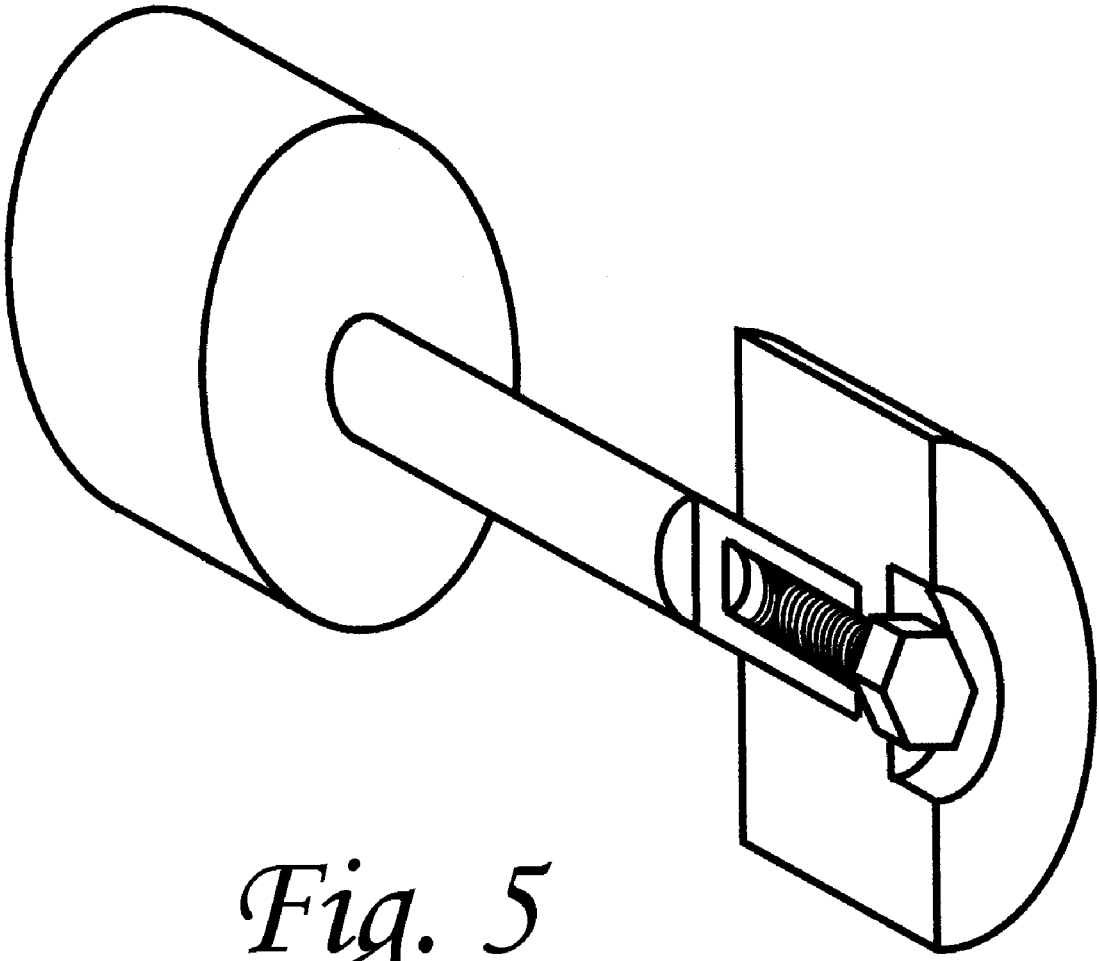
FIG. 5 shows a partial cut-out view of the first embodiment of present invention.

FIG. 5 shows a cut-out view of assembled weight head to the handle bar, as depicted by present invention.

FIGS. 6–9 show a second embodiment of present invention.

In second embodiment, the bolt and the locking nut are separated. The end portion of the handle bar contains threads to receive locking nut. Like the first embodiment, the 'stub' portion on the handle bar remains the same diameter as the central portion of the handle bar, so that there will not be weak point in the load-bearing part of the handle bar.

Figure 6:
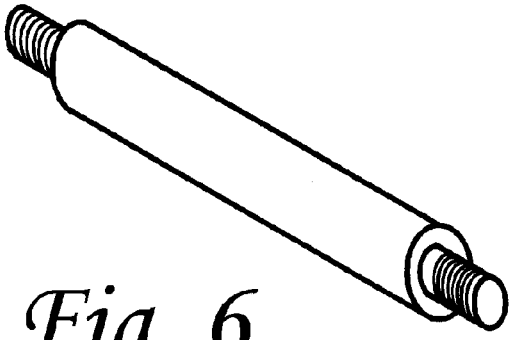
FIG. 6 shows a second embodiment of the central handle bar of present invention.
Figure 7:
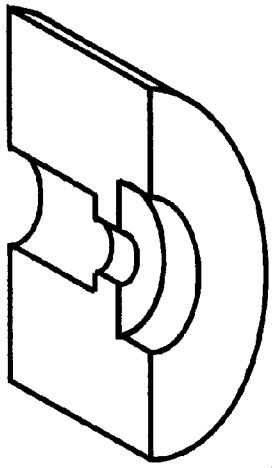
FIG. 7 shows a second embodiment of weight heads of present invention.
Figure 8:
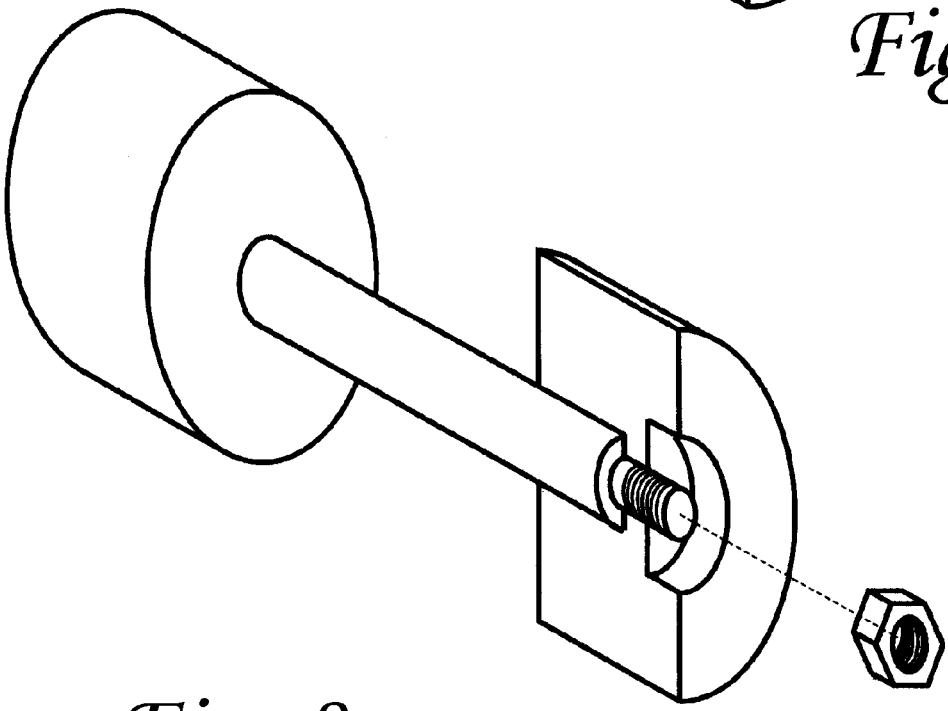
FIG. 8 shows an exploded view for the second embodiment of present invention.
Figure 9:
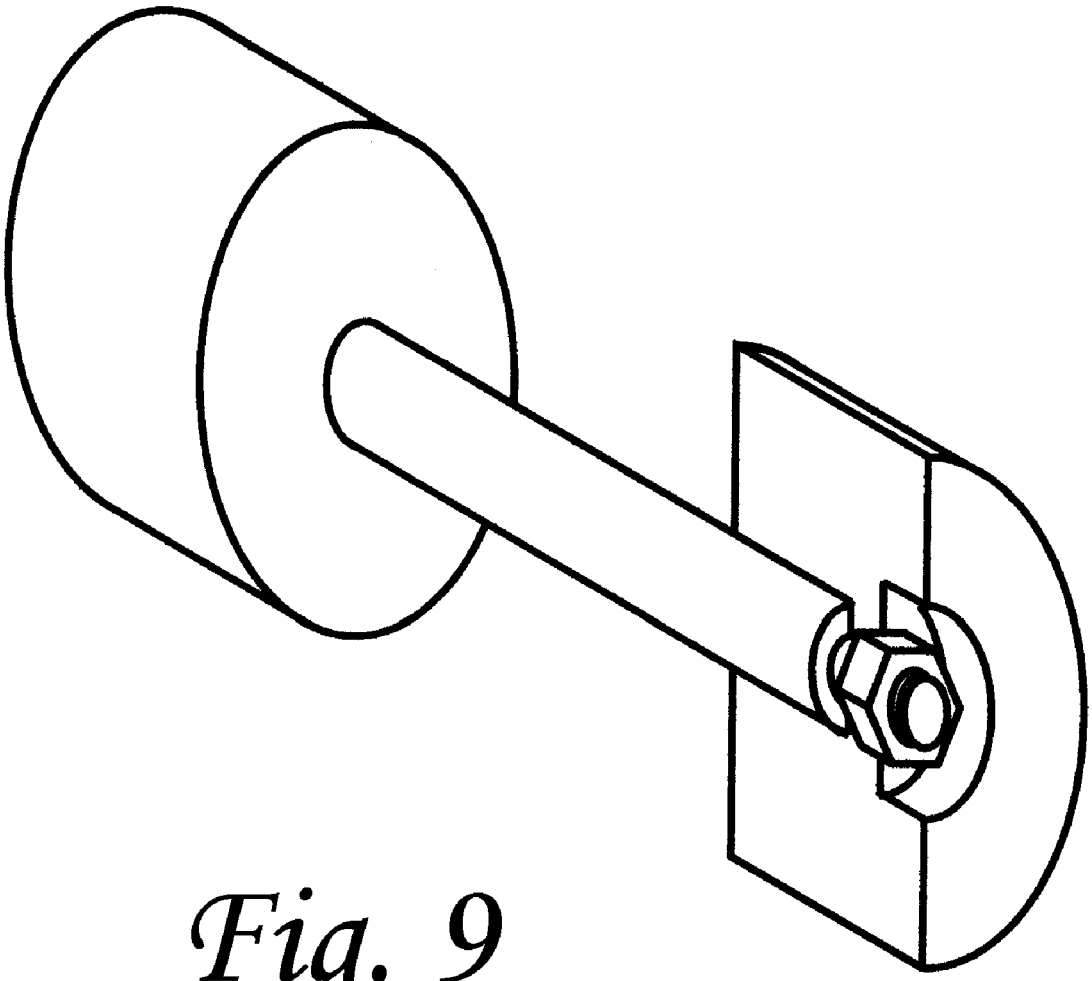
FIG. 9 shows a partial cut-out view of the second embodiment of present invention.

The two end portions of the central handle bar will have machined threads to receive the locking nuts. To use the same weight head through hole configuration as in first embodiment, the threaded portion at two ends of the central handle bar will be machined down in diameter, as shown in FIGS. 6 and 8.

Figure 10:
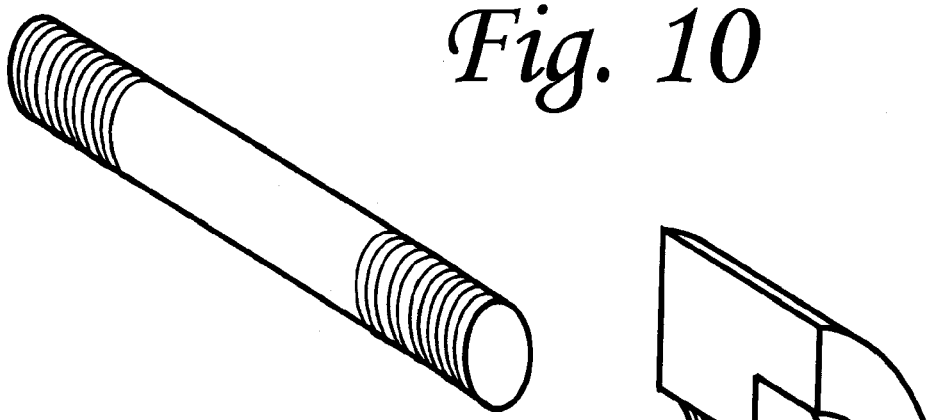
FIGS. 10 and 11 show a third embodiment of present invention.
Figure 11:
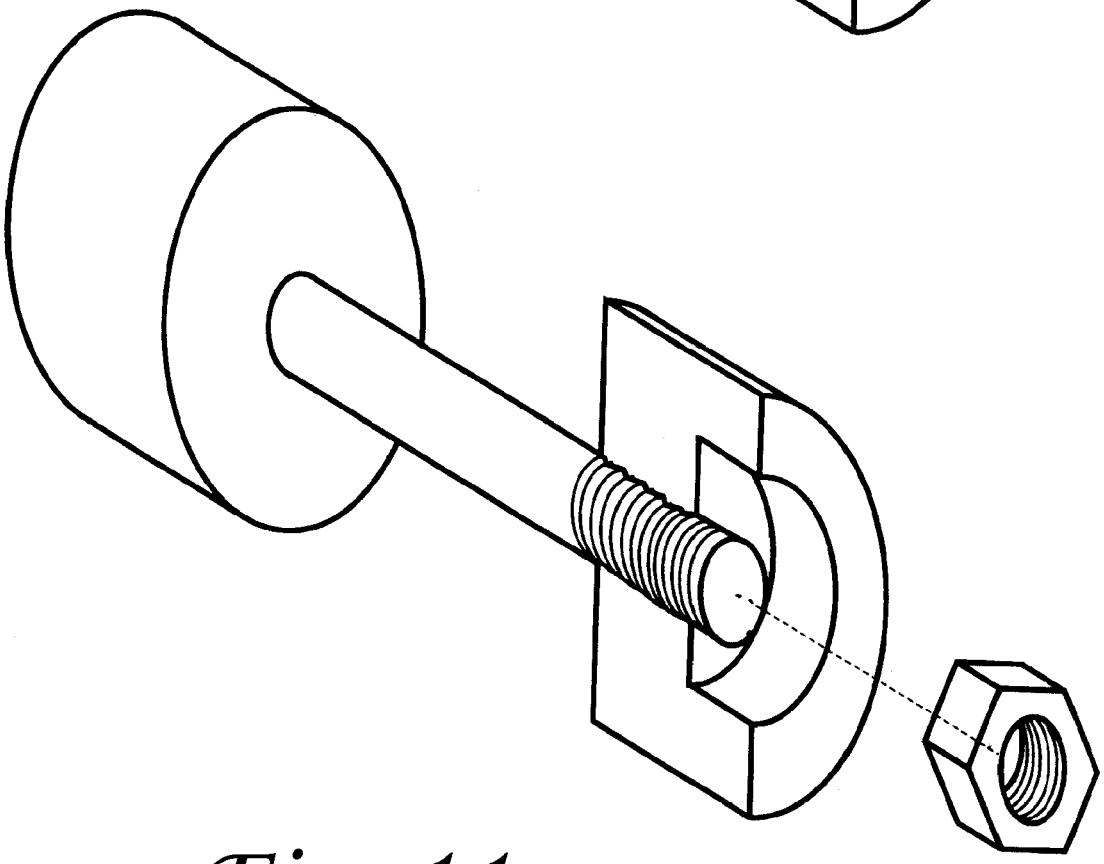

Alternatively, if the threaded portion on end portion of the handlebar is not machined down in diameter, as shown in FIGS. 10 and 11, then the weight head through hole configuration will consist of only 2 sections, one sized and threaded for receiving the 'stub' portion of the handle which contains screw threads, and another sized for receiving the capping piece of a tool, such as a wrench, when tightening or loosening the nut for the threaded portion of the stub.

As shown in FIGS. 10 and 11, central handle bar does not need the use of a pair of 'collar', simply because the weight heads will not slide inwards when the end of the thread on the central bar is reached.

Figure 12:
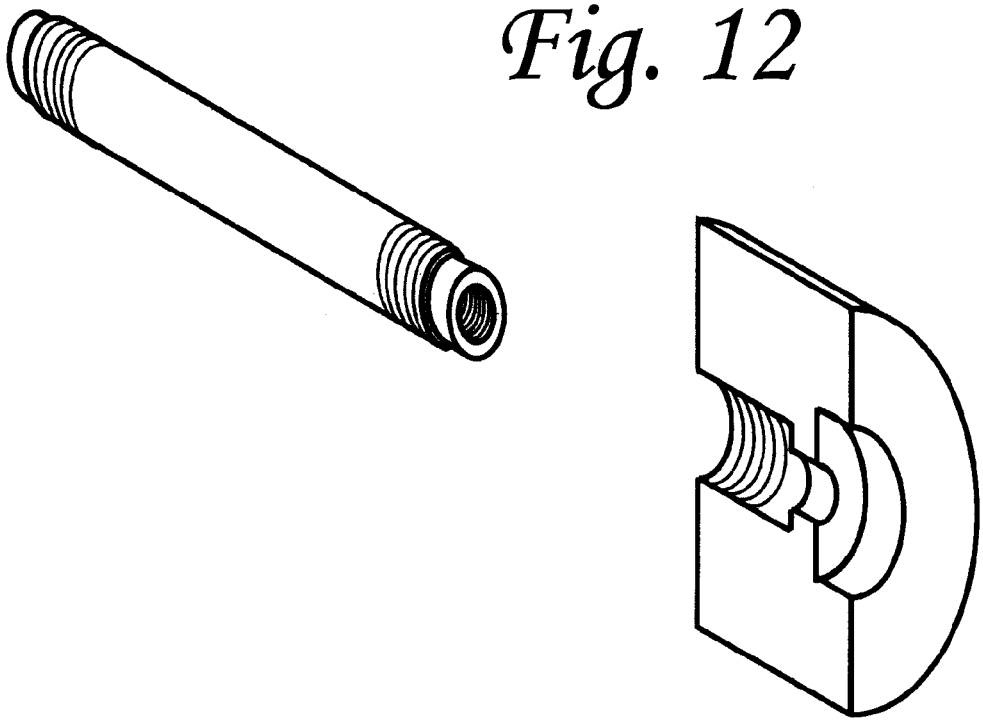
FIGS. 12 and 13 show a fourth embodiment of present invention.
Figure 13:
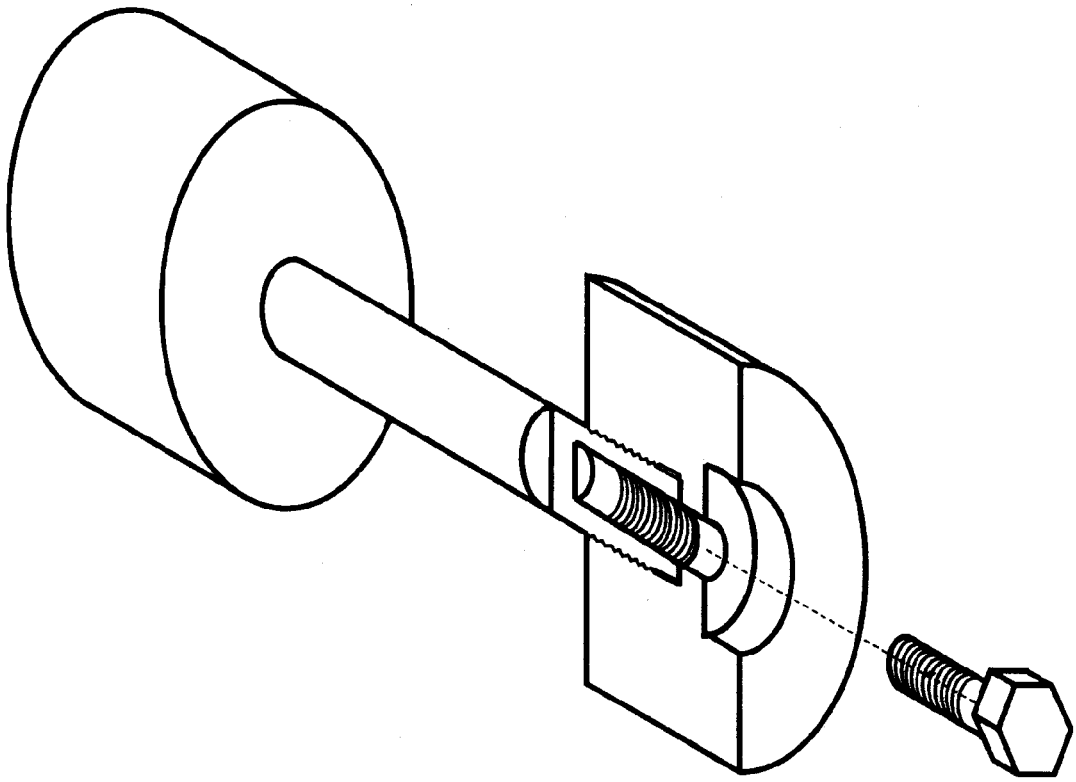

FIGS. 12 and 13 show a fourth embodiment of present invention, wherein several of the individual features in the prior 3 embodiments are combined.

In this embodiment, the weight head contains 3 sections, similar to the 3 sections of the weight head in the first embodiment. However, the section for receiving the 'stub' portion of the handle bar is threaded.

The two 'stub" portions of the central bar contains a machined-down portion and then some lengths of the handle bar, further inward from the machined-down portion, are machined to produce external thread lines, so that the external thread lines on the handle bar will be fitted into the internal threadlines on the weightheads, producing no weak point at the junction between handle bar and the weightheads, because the 'weak point' in this embodiment is the junction between the external threadline and the machined-down portion, which is completely enclosed in the inside of the weightheads.

Two non-through holes, having machined threads in the inside wall, are made axially from two ends of the handle bar, so that a bolt with locking nut can be utilized to secure and tighten the weight head to the central bar, from both directions.

In summary, all the four embodiments in present invention greatly increase the durability of a central bar on dumbbells by eliminating the formation of a weak joint.

What is claimed is:

1. A weight heads assembly apparatus, comprising:

a. a central handlebar having a first diameter and lengths from both ends machined and tapered down to a produce a reduced second diameter at each end of said central handlebar;

b. said central handlebar further having a non-through hole drilled axially inside of said central handlebar, with threadlines on the inside wall of said non-through hole;

c. both ends of said first diameter of the central handlebar machined to produce external threadlines;

d. a pair of bolts with locking nuts attached thereto, said bolts having external threadlines along the lengths of the bolts matching the internal threadlines of said central handlebar; and, e. weight heads each having a through hole having three diameters, the first diameter of said weight heads machined with internal threadlines to fittingly receive the external threadlines along the first diameter of said central handlebar, the second diameter of said weight heads machined to fittingly receive the reduced second diameter of said central handlebar, and the third diameter machined to fittingly receive the diameter of a capping tool for tightening said locking nuts.

* * * * *